US007249416B2

(12) United States Patent
Yamaguchi et al.

(10) Patent No.: US 7,249,416 B2
(45) Date of Patent: Jul. 31, 2007

(54) COMB-VIBRATION PREVENTING STRUCTURE FOR HAIR CUTTER

(75) Inventors: Takashi Yamaguchi, Hikone (JP); Hitoshi Ogawa, Inukami-gun (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 11/211,637

(22) Filed: Aug. 26, 2005

(65) Prior Publication Data

US 2006/0042095 A1 Mar. 2, 2006

(30) Foreign Application Priority Data

Sep. 1, 2004 (JP) ..... 2004-254009

(51) Int. Cl.
*B26B 19/02* (2006.01)
*B26B 19/20* (2006.01)

(52) U.S. Cl. ..... 30/43.91; 30/200; 30/201

(58) Field of Classification Search ..... 30/55, 30/65, 70, 71, 201, 212, 43.91, 54, 200, 202, 30/233, 233.5
See application file for complete search history.

(56) References Cited

U.S. PATENT DOCUMENTS 1,844,053 A * 2/1932 Beatty ..... 215/294
2,132,898 A 10/1938 Hamel
2,565,697 A * 8/1951 Odstrcil ..... 310/29
3,041,726 A * 7/1962 Hitson ..... 30/201
3,149,418 A * 9/1964 Milbourne ..... 30/201
3,440,724 A * 4/1969 Wich et al. ..... 30/43.91
3,440,725 A * 4/1969 Messinger et al. ..... 30/43.91
3,711,948 A * 1/1973 Ford et al. ..... 30/212
3,844,036 A 10/1974 Wahl et al.
3,913,225 A * 10/1975 Tietjiens et al. ..... 30/43.6
4,622,745 A * 11/1986 Wahl ..... 30/201
4,949,460 A 8/1990 Sterk
5,327,648 A * 7/1994 Ullmann ..... 30/43.1
5,632,087 A * 5/1997 Motohashi et al. ..... 30/43.92

(Continued)

FOREIGN PATENT DOCUMENTS

JP 1-214388 8/1989

OTHER PUBLICATIONS

"Fourslide". Springs and Stampings. Three pictures from www.fourslide.com last viewed Nov. 6, 2006.*
English Language Abstract of JP 1-214388.
English language Abstract of JP 1-214388.
English language Abstract of EP 0325326.

*Primary Examiner*—Kenneth E. Peterson
*Assistant Examiner*—Sean Michalski
(74) *Attorney, Agent, or Firm*—Greenblum & Bernstein, P.L.C.

(57) ABSTRACT

Disclosed is a comb-vibration preventing structure for a hair cutter including a cutter body and a cutting-length adjusting comb adapted to be fitted on an upper portion of the cutter body and vertically moved in a sliding manner so as to adjust a cutting length. The comb-vibration preventing structure comprises a wire spring for urging each of opposite inner side surfaces of the cutting-length adjusting comb in an outward thrusting manner in an opposite lateral direction. The comb-vibration preventing structure can prevent vibrations of the cutting-length adjusting comb to reduce chatter noises, and achieve enhanced usability while facilitating quality control.

2 Claims, 8 Drawing Sheets

U.S. PATENT DOCUMENTS 5,699,616 A 12/1997 Ogawa
6,260,276 B1 7/2001 Lebherz et al.
6,279,234 B1 8/2001 Chaouachi et al.
6,568,083 B1 * 5/2003 Taniguchi et al. ..... 30/43.2
6,578,269 B2 * 6/2003 Wilcox et al. ..... 30/201
6,968,623 B2 * 11/2005 Braun et al. ..... 30/201

* cited by examiner

COMB-VIBRATION PREVENTING STRUCTURE FOR HAIR CUTTER

FIELD OF THE INVENTION

The present invention relates to an improvement of a comb-vibration preventing structure for a hair clipper or cutter.

DESCRIPTION OF THE BACKGROUND ART

Heretofore, there has been known a hair cutter comprising a cutter body and a cutting-length adjusting comb adapted to be fitted on an upper portion of the cutter body and vertically moved in a sliding manner so as to adjust a cutting length of hair or beard as shown in Japanese Patent Laid-Open Publication No. 01-214388

As for a mounting technique disclosed in this Patent Publication, the cutting-length adjusting comb is simply fitted on the upper portion of the cutter body. Thus, the cutting-length adjusting comb is liable to shake or wobble due to lateral vibrations in a blade block and cause a problem about occurrence of chatter noises.

While this wobbling may be avoided by improving a fitting accuracy of the cutting-length adjusting comb relative to the cutter body, this approach involves problems about poor usability due to increase in sliding resistance of the cutting-length adjusting comb, and difficulties in quality control.

SUMMARY OF THE INVENTION

In view of the above problems, it is an object of the present invention to provide a comb-vibration preventing structure for a hair cutter which can prevent vibrations of a cutting-length adjusting comb to reduce chatter noises, and achieve enhanced usability while facilitating quality control.

According to an aspect of the present invention, a comb-vibration preventing structure for a hair cutter is provided with a cutter body and a cutting-length adjusting comb detachably adapted to be fitted on an upper portion of the cutter body and vertically moved in a sliding manner so as to adjust a cutting length.

The comb-vibration preventing structure comprises an elastic member for urging each of opposite inner side surfaces of the cutting-length adjusting comb in an outward thrusting manner in an opposite lateral direction.

Other features and advantages of the present invention will be apparent from the accompanying drawings and from the detailed description.

BRIEF DESCRIPTION OF DRAWINGS

FIGS. 4A to 4C show the cutting-length adjusting comb, wherein FIG. 4A is a front view thereof, FIG. 4B is a bottom view thereof, and FIG. 4C is a sectional view taken along the line 4C-4C in FIG. 4A.

FIGS. 5A and 5B show a cutter body and a wire spring, wherein FIG. 5A is a perspective view thereof in the state after the wire spring is incorporated in the cutter body, and FIG. 5B is a perspective view thereof in the state before the wire spring is incorporated in the cutter body.

FIGS. 6A and 6B schematically show an upper portion of the cutter body and the cutting-length adjusting comb, wherein FIG. 6A is a sectional view thereof in the state after the cutting-length adjusting comb is attached to the cutter body, and FIG. 6B is a sectional view thereof in the state after the cutting-length adjusting comb is detached therefrom.

FIGS. 7A and 7B show a hair cutter as a comparative example, wherein FIG. 7A is a partly sectional side view thereof in the state after a cutting-length adjusting comb is slidingly moved to the uppermost position, and FIG. 7B is a partly sectional side view thereof in the state after the cutting-length adjusting comb is slidingly moved to the lowermost position.

DESCRIPTION OF THE PREFERRED EMBODIMENTS OF THE INVENTION

With reference to the drawings, the best mode for implementing the present invention will now be described in detail.

Figure 1:
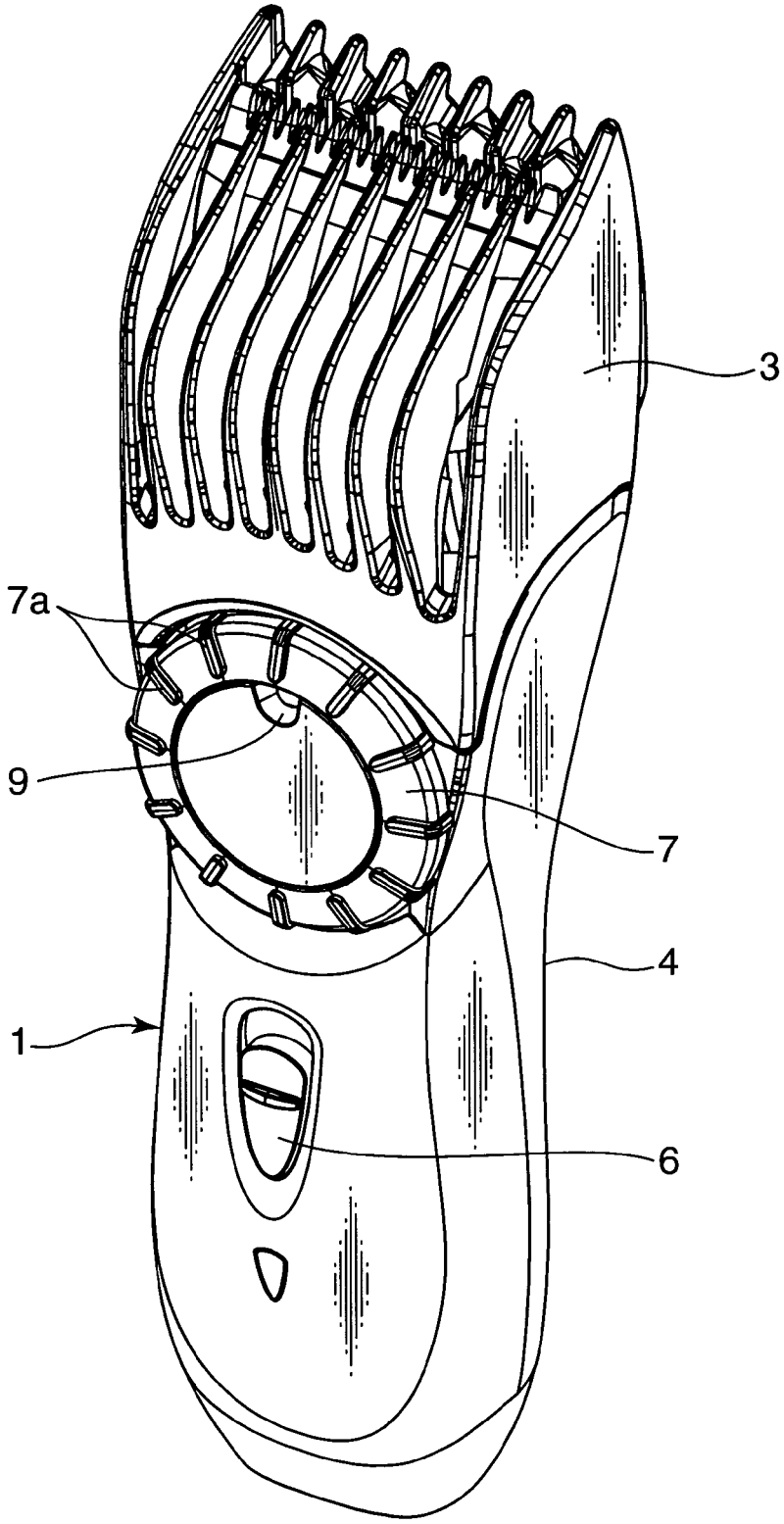
FIG. 1 is a perspective view showing a hair cutter having a comb-vibration preventing structure according to an embodiment of the present invention.
Figure 2:
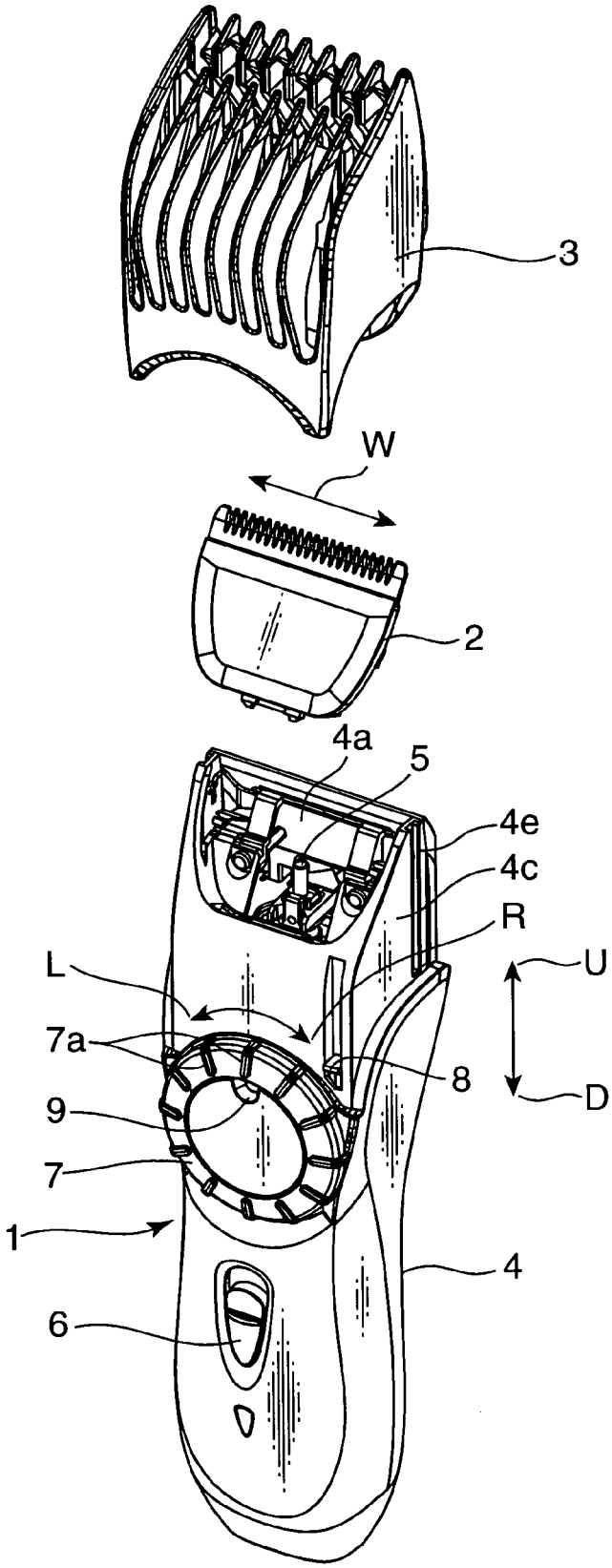
FIG. 2 is an exploded perspective view showing the hair cutter in the state after a blade block and a cutting-length adjusting comb are detached therefrom.
Figure 3:
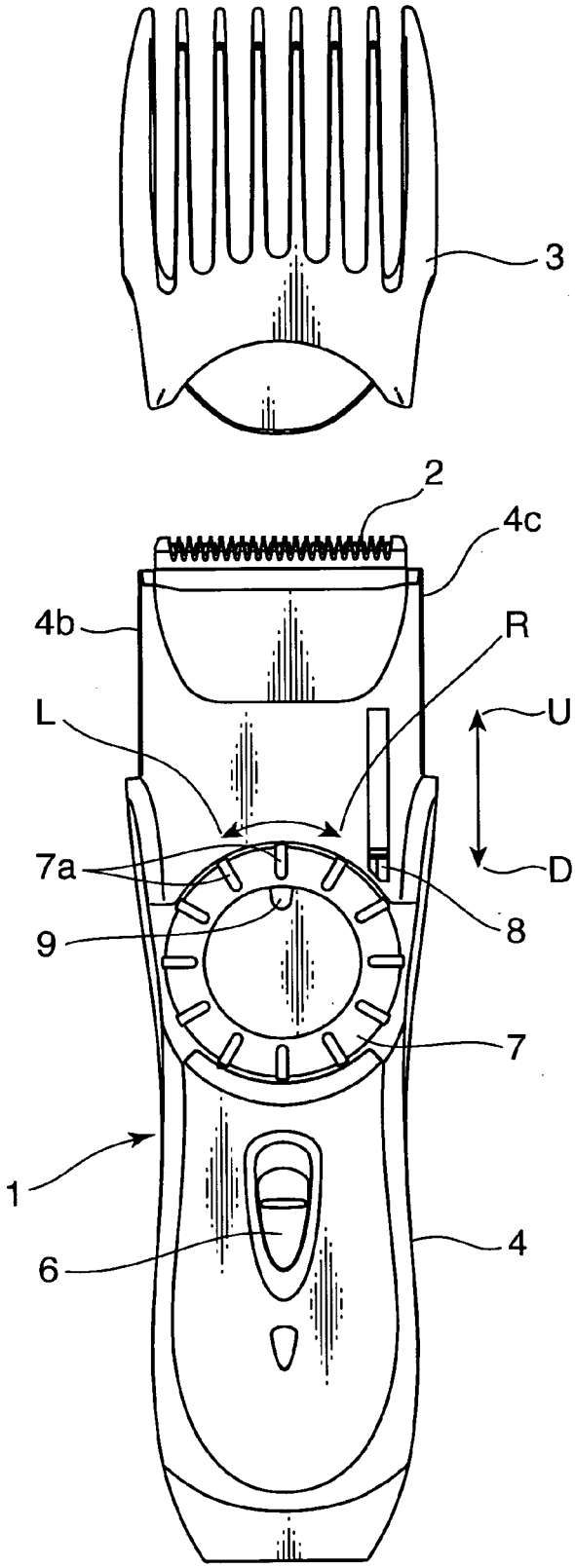
FIG. 3 is a front view showing the hair cutter in the state after the cutting-length adjusting comb is detached therefrom.
Figure 4A:
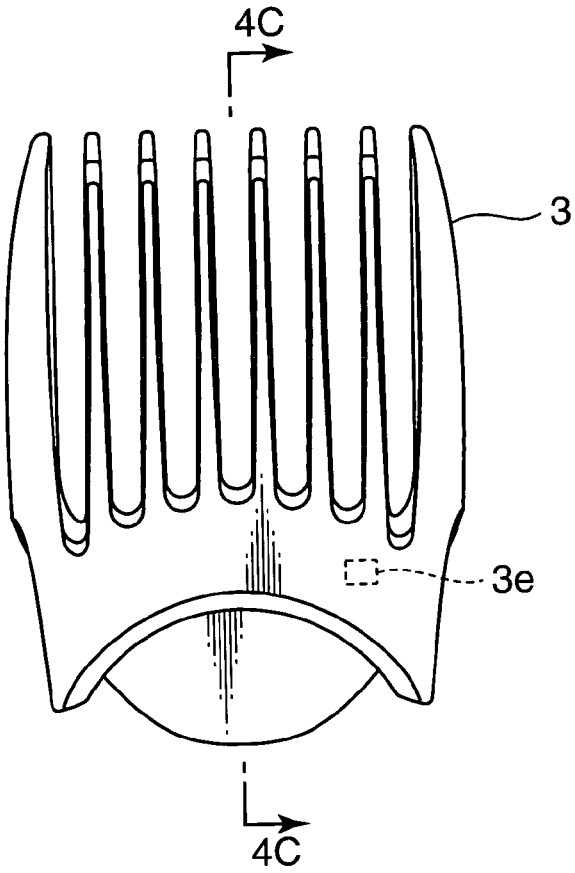
Figure 4C:
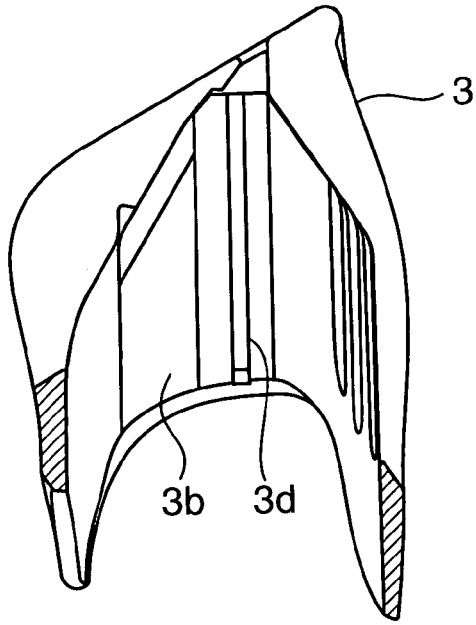
Figure 4B:
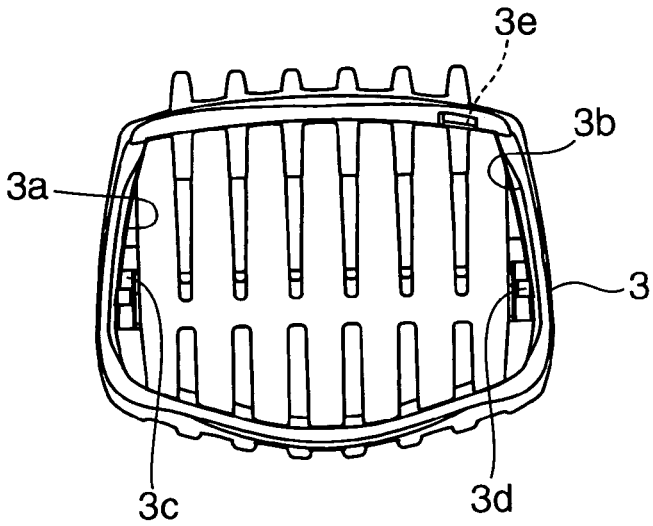
Figure 5A:
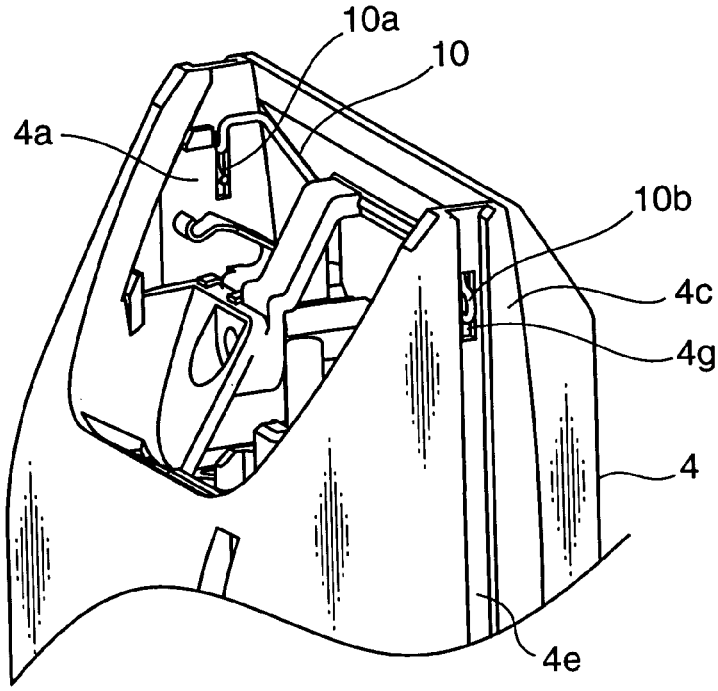
Figure 5B:
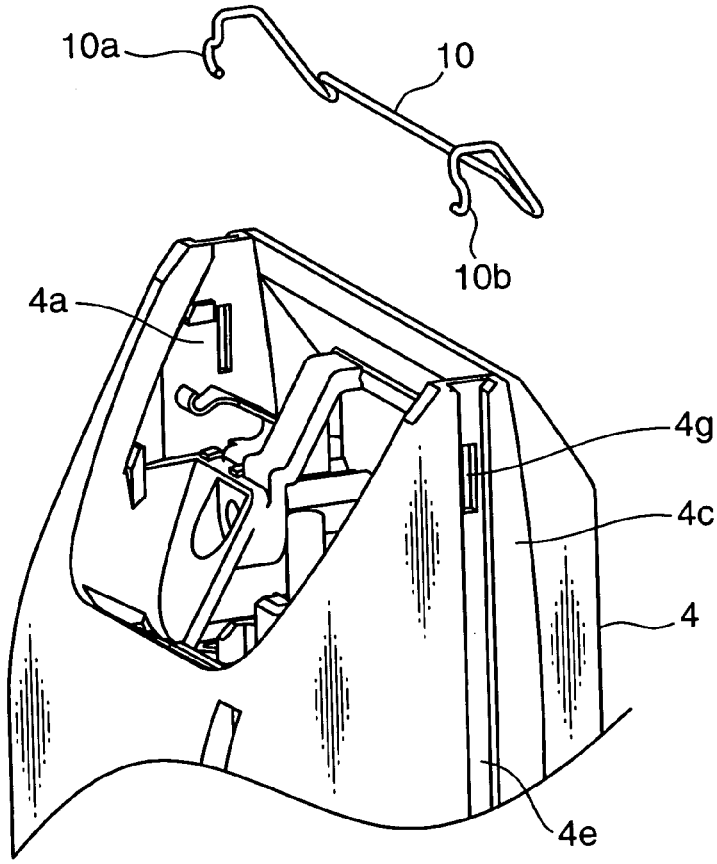

FIG. 1 is a perspective view showing a hair cutter 1 having a comb-vibration preventing structure according to an embodiment of the present invention. FIG. 2 is an exploded perspective view showing the hair cutter 1 in the state after a blade block 2 and a cutting-length adjusting comb 3 are detached therefrom, and FIG. 3 is a front view showing the hair cutter 1 in the state after the cutting-length adjusting comb 3 is detached therefrom.

The hair cutter 1 includes a cutter body 4 formed to have an outer shape suitable for being gripped with one hand. The cutter body 4 has an upper-end opened space 4*a* formed to allow a blade block 2 to be detachably attached thereto.

The blade block 2 comprises a stationary blade and a movable blade. The movable blade is adapted to be engaged with a driving pin 5 (see FIG. 2) located inside the upper-end opened space 4*a* of the cutter body 4. This driving pin 5 is designed to be reciprocated in a lateral direction W at a high speed by an electric motor housed in the cutter body 4. Thus, hair or beard can be cut by the movable blade reciprocated in the lateral direction W at a high speed by the driving pin 5.

The cutter body 4 has a front surface provided with a slide switch 6 for turning on/off the electric motor for reciprocating the driving pin 5, and a manual operation dial 7 for vertically moving the cutting-length adjusting comb 3 in a sliding manner.

As shown in detail in FIGS. 4A to 6B, an upper portion of the cutter body 4 has opposite outer side surfaces formed, respectively, with two vertically-extending line-shaped guide grooves 4*d*, 4*e*, and the cutting-length adjusting comb 3 has opposite inner side surfaces formed, respectively, with two vertically-extending line-shaped guide protrusions 3*c*, 3*d* engageable with the corresponding guide grooves 4*d*, 4*e*.

The cutting-length adjusting comb 3 is designed to be fitted on the upper portion of the cutter body 4 with an appropriate gap therebetween in such a manner as to cover over the blade block 2 attached to the upper end of the cutter body 4. Further, when the cutting-length adjusting comb 3 is fitted on the upper portion of the cutter body 4, the guide protrusions 3*c*, 3*d* of the cutting-length adjusting comb 3 will be engaged with and guided by the corresponding guide grooves 4*d*, 4*e* of the cutter body 4, to allow the cutting-length adjusting comb 3 to be vertically moved in a sliding manner smoothly relative to the cutter body 4.

As shown in FIGS. 2 and 3, the front surface of the cutter body 4 is also provided with a hook member 8 adapted to be moved in conjunction with a rotating operation of the manual operation dual 7 through an interlocking mechanism (pinion, rack, etc.) interlocked with the rotating operation of the manual operation dual 7, for example, in a downward direction D and in an upward direction U when the manual operation dual 7 is manually rotated, respectively, in a clockwise direction R and in a counterclockwise direction L. When the cutting-length adjusting comb 3 is fitted on the upper portion of the cutter body 4, this hook member 8 will be detachably engaged with a hook groove 3*e* (see FIGS. 4A and 4B) of the cutting-length adjusting comb 3.

Then, when the hook member 8 is moved in the downward direction D in conjunction with the operation of the manual operation dual 7 in the clockwise direction R, the cutting-length adjusting comb 3 is slidingly moved in the downward direction D by the hook member 8. Conversely, when the hook member 8 will be moved in the upward direction U in conjunction with the operation of the manual operation dual 7 in the counterclockwise direction L, the cutting-length adjusting comb 3 will be slidingly moved in the upward direction U by the hook member 8.

The manual operation dial 7 has a front surface formed with a plurality of indicator protrusions 7*a* at even intervals in a circumferential direction to additionally serve as a finger gripper or slip stopper. The manual operation dial 7 is also associated with a click mechanism (not shown) for providing a click feeling, for example, at each trisected position between the adjacent indicator protrusions 7*a*. The front surface of the cutter body 4 is further provided with a window 9 located on the inward side of the manual operation dial 7 and designed to indicate a numerical character (e.g. 1 to 12) assigned correspondingly to each of the indicator protrusions 7*a* of the manual operation dial 7 to give an index of a cutting length.

As shown in 5A to 6B, two through-holes 4*f*, 4*g* are formed in the cutter body 4, respectively, at positions adjacent to upper ends of the guide grooves 4*d*, 4*e*, to penetratingly extend from the bottoms of the corresponding guide grooves 4*d*, 4*e* into the upper-end opened space 4*a*.

A single wire spring (elastic member) 10 is prepared to have opposite ends formed, respectively, with contact portions 10*a*, 10*b* bent in an outward-protruding U shape. This wire spring 10 is fitted into the upper-end opened space 4*a* of the cutter body 4 in such a manner as to allow the contact portions 10*a*, 10*b* to protrude from the corresponding through-holes 4*f*, 4*g* into the upper end regions of the corresponding guide grooves 4*d*, 4*e*.

Figure 6A:
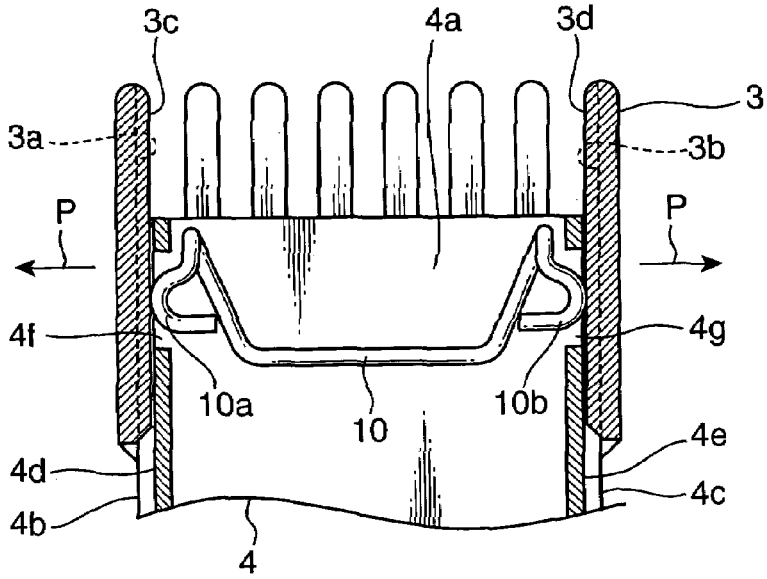
Figure 6B:
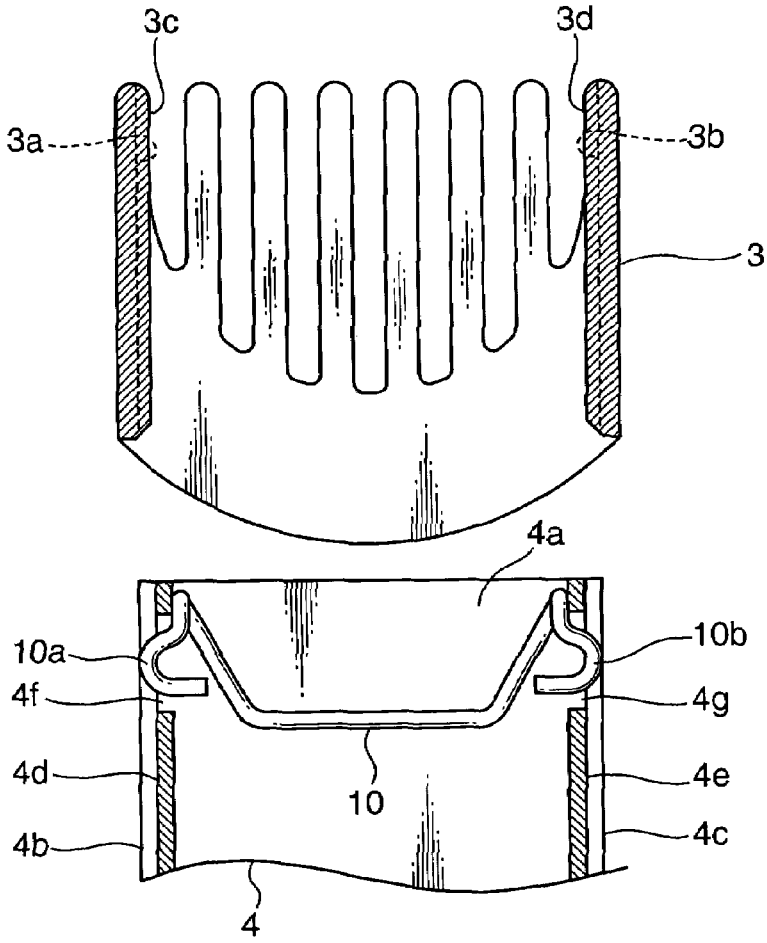

When the cutting-length adjusting comb 3 is fitted on the upper portion of the cutter body 4, the contact portions 10*a*, 10*b* of the wire spring 10 will come into contact with the corresponding guide protrusions 3*c*, 3*d* of the cutting-length adjusting comb 3 engaged with the guide grooves 4*d*, 4*e* of the cutter body 4, and urge each of opposite inner side surfaces 3*a*, 3*b* of the cutting-length adjusting comb 3 in an outward thrusting manner in an opposite lateral direction (see the arrow P in FIG. 6A).

According to the hair cutter 1 having the above comb-vibration preventing structure, the wire spring 10 can urge each of opposite inner side surfaces 3*a*, 3*b* of the cutting-length adjusting comb 3 in an outward thrusting manner in the opposite lateral direction P. This makes it possible to prevent a wobbling movement of the cutting-length adjusting comb 3 without the need for improving a fitting accuracy of the cutting-length adjusting comb 3 relative to the cutter body 4, so that the occurrence of chatter noises can be reduced. In particular, the structure designed to thrust the opposite inner side surfaces 3*a*, 3*b* of the cutting-length adjusting comb 3 in the same directions as the reciprocating directions of the blade block 2 by the wire spring 10 can effectively prevent a wobbling movement of the cutting-length adjusting comb 3. In addition, this function is achieved only by urging the cutting-length adjusting comb 3 in an outward thrusting manner in the opposite lateral direction P through the use of the wire spring 10. Thus, the sliding movement of the cutting-length adjusting comb 3 can be smoothly performed to provide enhanced usability.

Further, in the above comb-vibration preventing structure, the wire spring 10 fixed to the cutter body 4 is designed to come into contact with the guide protrusions 3*c*, 3*d* formed on the opposite inner side surfaces 3*a*, 3*b* of the cutting-length adjusting comb 3. Thus, the wire spring 10 can have a fixed contact position, and only the guide protrusions 3*c*, 3*d* formed on the opposite inner side surfaces 3*a*, 3*b* of the cutting-length adjusting comb 3 can have scratches due to the contact with the wire spring 10. This makes it possible to prevent deterioration in appearance.

The guide grooves 4*d*, 4*e* engageable with the guide protrusions 3*c*, 3*d* of the opposite inner side surfaces 3*a*, 3*b* of the cutting-length adjusting comb 3 are formed in opposite outer side surfaces 4*b*, 4*c* of the cutter body 4. This allows the cutting-length adjusting comb 3 to be slidingly moved smoothly along the cutter body 4. In addition, the contact portions 10*a*, 10*b* of the wire spring 10 contained in the guide grooves 4*d*, 4*e* can provide enhanced appearance.

Further, the wire spring 10 is comprised of a single wire spring, and the opposite ends of the wire spring 10 are formed with the contact portions 10*a*, 10*b* adapted to come into contact with the guide grooves 3*c*, 3*d*. Thus, an additional component can be limited to only the single wire spring 10 to provide a simplified structure at low cost.

The wire spring 10 is supported by the through-holes 4*f*, 4*g* allowing the contact portions 10*a*, 10*b* to protrude into the guide grooves 4*d*, 4*e*. This makes it possible to eliminate the need for an additional retainer so as to provide a more simplified structure at lower cost.

Furthermore, the wire spring 10 is disposed in the upper end region of the cutter body 4. This makes it possible to prevent a wobble movement of the cutting-length adjusting comb 3 over the entire stroke of the cutting-length adjusting comb 3 only by the single wire spring 10.

Figure 7A:
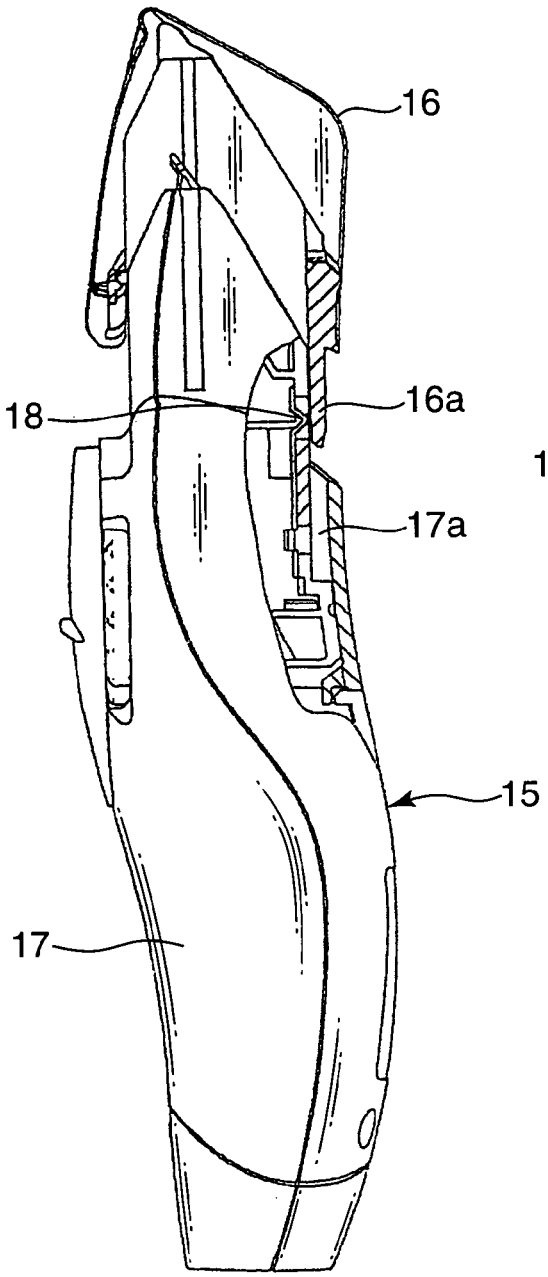
Figure 7B:
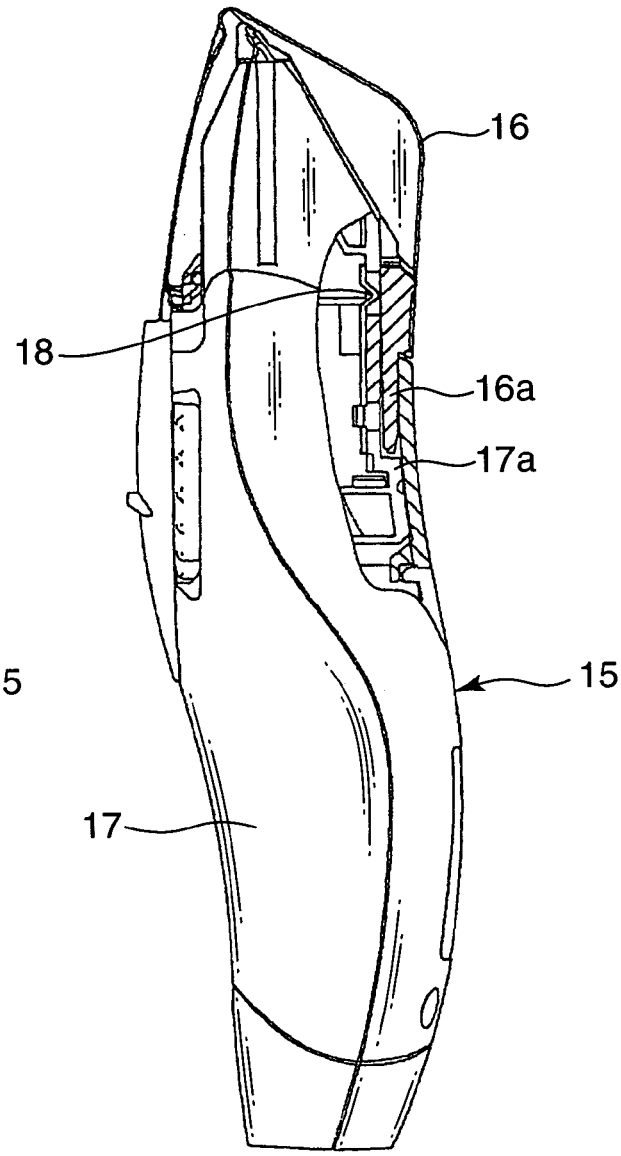
Figure 8:
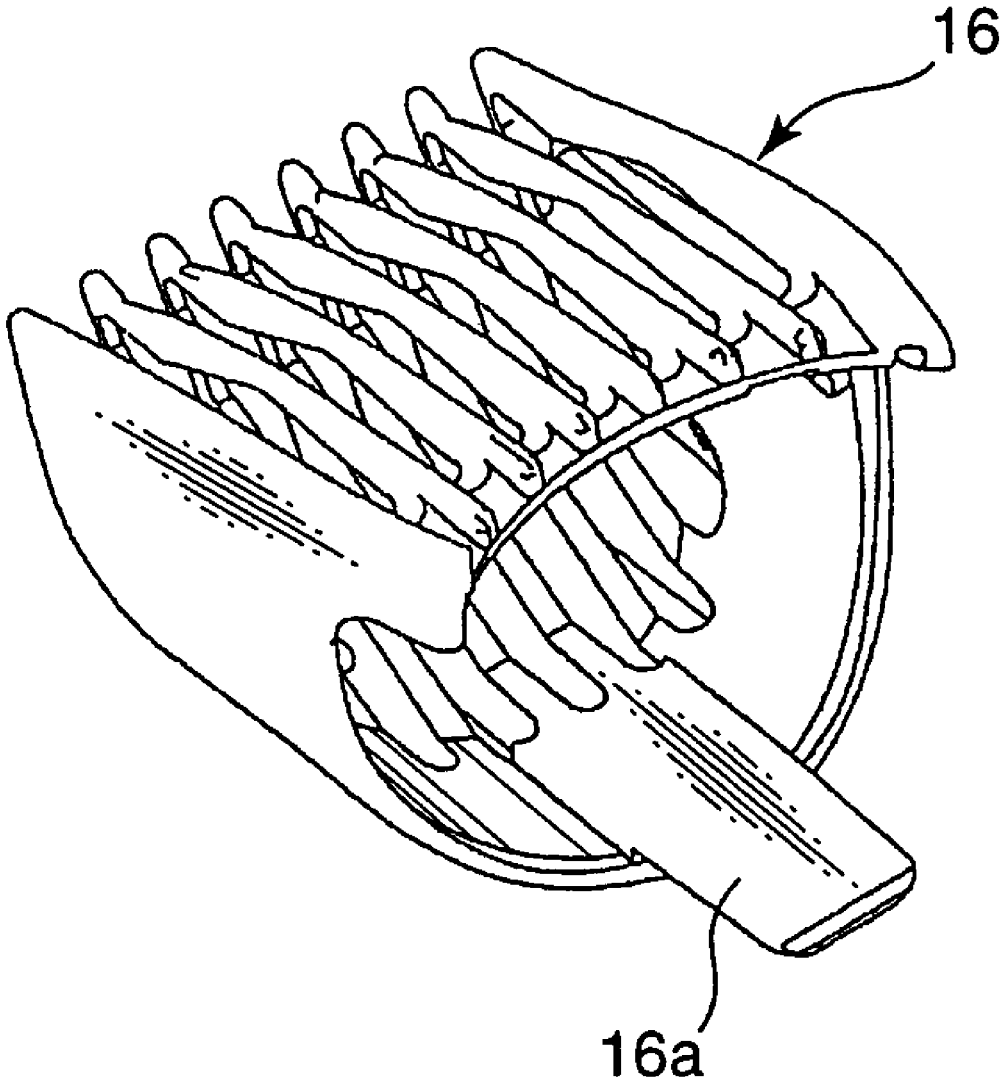
FIG. 8 is a perspective view showing the comparative example.

FIGS. 7A, 7B and 8 show a hair cutter 15 as a comparative example. This hair cutter 15 comprises a cutting-length adjusting comb 16 having a back lower end formed with an insertion portion 16*a* extending downward. This hair cutter 15 is designed to insert a part of the insertion portion 16*a* into a receiving groove 17*a* formed in a cutter body 17, and pressingly urge the insertion portion 16*a* backward by a leaf spring (elastic member) 18 disposed inside a cutter body 17, so as to prevent a wobbling movement of the cutting-length adjusting comb 16 to reduce chatter noises.

This comparative structure is required to have the insertion portion 16*a* formed in the cutting-length adjusting comb 16, and the receiving groove 17*a* formed in the cutter body 17. This requirement causes a problem about increased restrictions in design. Moreover, scratches formed in the insertion portion 16*a* due to the contact with the leaf spring

18 will cause a problem about deteriorated appearance when the cutting-length adjusting comb 16 is detached from the cutter body 17.

In contrast, the comb-vibration preventing structure according to the above embodiment is designed to urge each of the opposite inner side surfaces 3*a*, 3*b* of the cutting-length adjusting comb 3 in an outward thrusting manner in the opposite lateral direction P. Thus, the need for providing the insertion portion 16*a* and the receiving groove 17*a* can be eliminated to reduce restrictions in design. In addition, only the guide protrusions 3*c*, 3*d* of the opposite inner side surfaces 3*a*, 3*b* of the cutting-length adjusting comb 3 can have scratches due to the contact with the wire spring 10. Thus, even after the cutting-length adjusting comb 3 is detached from the cutter body 4, the scratched guide protrusions 3*c*, 3*d* of the opposite inner side surfaces 3*a*, 3*b* are unlikely to be seen from the outside. This makes it possible to provide enhanced appearance.

As described above, a comb-vibration preventing structure for a hair cutter is provided with a cutter body and a cutting-length adjusting comb detachably adapted to be fitted on an upper portion of the cutter body and vertically moved in a sliding manner so as to adjust a cutting length. The comb-vibration preventing structure comprises an elastic member for urging each of opposite inner side surfaces of the cutting-length adjusting comb in an outward thrusting manner in an opposite lateral direction.

The comb-vibration preventing structure may be preferably designed such that the opposite inner side surfaces of the cutting-length adjusting comb are formed, respectively, with line-shaped guide protrusions, and the elastic member is adapted to come into contact with the respective guide protrusions.

The cutter body may have opposite outer side surfaces formed, respectively, with line-shaped guide grooves. In this case, the elastic member may be at least partly located in the respective guide grooves.

The elastic member may be comprised of a single wire spring having opposite ends formed, respectively, with contact portions adapted to come into contact with the corresponding guide protrusions.

Further, the cutter body may be formed with a through-hole supporting the wire spring in such a manner as to allow the contact portions to protrude into the corresponding guide grooves.

The wire spring may be disposed in an upper end region of the cutter body.

The comb-vibration preventing structure is designed to urge each of the opposite inner side surfaces of the cutting-length adjusting comb in an outward thrusting manner in an opposite lateral direction by means of the elastic member. This makes it possible to prevent a wobbling movement of the cutting-length adjusting comb without the need for improving a fitting accuracy of the cutting-length adjusting comb relative to the cutter body, so that the occurrence of chatter noises can be reduced. In addition, this function is achieved only by urging the cutting-length adjusting comb in an outward thrusting manner in an opposite lateral direction through the use of the elastic member. Thus, the sliding movement of the cutting-length adjusting comb can be smoothly performed to provide enhanced usability.

This application is based on patent application No. 2004-254009 filed in Japan, the contents of which are hereby incorporated by references.

An advantageous embodiment of the invention has been shown and described. It is obvious to those skilled in the art that various changes and modifications may be made therein without departing from the spirit and scope thereof as set forth in appended claims.

What is claimed is:

1. A hair cutter including a cutter body, a cutting-length adjusting comb adapted to be fitted on an upper portion of the cutter body and vertically moved in a sliding manner so as to adjust a cutting length, and a comb-vibration preventing structure comprising an elastic member for urging each of opposite inner side surfaces of the cutting-length adjusting comb in an outward thrusting manner in an opposite lateral direction;

wherein the opposite inner side surfaces of the cutting-length adjusting comb are formed, respectively, with line-shaped guide protrusions, and the elastic member is adapted to come into contact with the respective guide protrusions;

wherein the cutter body has opposite outer side surfaces formed, respectively, with line-shaped guide grooves, wherein the elastic member is at least partly located in the respective guide grooves; and wherein the elastic member consists of a single wire spring which has opposite ends formed, respectively, with contact portions adapted to come into contact with the corresponding guide protrusions; and wherein the cutter body is formed with a through-hole at a position adjacent to an upper end of each of the guide grooves for supporting the wire spring in such a manner as to allow each of the contact portions of the single wire spring to protrude into the corresponding guide groove.

2. The hair cutter as defined in claim 1, wherein the wire spring is disposed in an upper end region of the cutter body.

* * * * *

UNITED STATES PATENT AND TRADEMARK OFFICE

CERTIFICATE OF CORRECTION

PATENT NO. : 7,249,416 B2
APPLICATION NO. : 11/211637
DATED : July 31, 2007
INVENTOR(S) : Takashi Yamaguchi et al.

It is certified that error appears in the above-identified patent and that said Letters Patent is hereby corrected as shown below:

On the cover page of the printed patent, under (75) Inventors for inventor Takashi Yamaguchi, change "Hikone" to --Hikone-shi-- (JP).

Signed and Sealed this

Fifteenth Day of July, 2008

JON W. DUDAS
*Director of the United States Patent and Trademark Office*